US009232850B2

(12) United States Patent
Moreau et al.

(10) Patent No.: US 9,232,850 B2
(45) Date of Patent: Jan. 12, 2016

(54) COMBINATION TOOL CARRIER AND CARRIER SECURING LANYARD

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 698 days.

(21) Appl. No.: 13/468,202

(22) Filed: May 10, 2012

(65) Prior Publication Data

US 2013/0299544 A1 Nov. 14, 2013

(51) Int. Cl.
*A45C 1/04* (2006.01)
*A45F 5/02* (2006.01)
*A45F 5/00* (2006.01)

(52) U.S. Cl.
CPC . *A45F 5/02* (2013.01); *A45F 5/021* (2013.01); *A45F 2005/006* (2013.01); *A45F 2200/0575* (2013.01); *Y10T 29/49826* (2015.01)

(58) Field of Classification Search
CPC ..... A45F 2200/0575; A45F 2005/006; A45F 5/004; A45F 2003/144; A45F 5/02; A45F 5/021; F41C 33/029; A45C 1/04
See application file for complete search history.

(56) References Cited

U.S. PATENT DOCUMENTS 4,923,105 A * 5/1990 Snyder ..... A45F 3/14 224/232
5,341,975 A 8/1994 Marinescu
5,526,924 A * 6/1996 Klutznick ..... 206/5
6,244,485 B1 6/2001 Holland et al.
6,244,486 B1 6/2001 Holland et al.
8,028,872 B2 10/2011 Hamlin
8,220,683 B2 * 7/2012 Williams ..... A45F 3/14 224/662
2002/0014507 A1 * 2/2002 Snider ..... A45F 5/02 224/671
2002/0174521 A1 * 11/2002 Vidal, Jr. ..... A45F 5/004 24/3.1
2003/0218038 A1 * 11/2003 Chang ..... 224/647
2005/0284909 A1 * 12/2005 Munoz ..... A45C 1/04 224/674
2010/0032465 A1 * 2/2010 Moreau et al. ..... 224/660
2012/0168472 A1 * 7/2012 Mathews ..... 224/162
2015/0021372 A1 * 1/2015 Moreau ..... A45F 5/02 224/677

* cited by examiner

*Primary Examiner* — J. Gregory Pickett
*Assistant Examiner* — Todd Anderson
(74) *Attorney, Agent, or Firm* — Robert R. Deleault, Esq.; Mesmer & Deleault, PLLC

(57) ABSTRACT

A tool carrier for attaching to a user's belt or a user's harness includes a rear wall having an upper wall portion, a tool holder disposed on a front wall surface of the rear wall, a tool carrier safety lanyard removably connected to the front wall surface, the safety lanyard having a lanyard first end and a closed loop formed in a lanyard second end, an elongated first attachment member fixedly secured to a rear wall surface of the upper wall portion at a pair of spaced-apart first and second attachment locations thereon and defining a closed loop therebetween, and a first flexible strip forming an openable strip loop when a first strip end mates with a second strip end after being positioned through the closed loop of the elongated first attachment member.

12 Claims, 5 Drawing Sheets

COMBINATION TOOL CARRIER AND CARRIER SECURING LANYARD

BACKGROUND OF THE INVENTION

1. Field of the Invention

The present invention relates generally to tool carriers. Particularly, the present invention relates to tool carriers worn by a worker in the building and construction trades.

2. Description of the Prior Art

A wide variety of pouches, cases or other such containers or carriers have been devised for holding and organizing tools, tool accessories or other small articles.

Tool belts have been used in the construction trades for many years by workers such as carpenters, construction workers, electricians, plumbers, and the like. Specially designed holsters and carriers have been utilized for various types of tools, which are hung by the tool belt.

Belt-supported pouches or bags for carrying tools, nails, tacks, screws, bolts, etc. are well known. Generally, such apparatus consist of a belt worn by the user, with a series of fixedly attached leather pouches positioned around the belt. Some of the belt devices have also had provision for multiple tool pockets for carrying two or more tools. These belt-supported pouches typically have an enclosed loop for receiving a belt. Others have incorporated clips that slide over an upper longitudinal edge of a belt to facilitate attaching the pouch to the belt.

SUMMARY OF THE INVENTION

The prior art suffers from various disadvantages. Belt-supported tool pouches having an enclosed belt loop require a user to remove and/or disconnect the belt so that the belt is passed through the enclosed belt loop and then re-connected. Belt-supported tool pouches having a clip can be inadvertently or accidently removed from the belt, especially where an upward force is inadvertently or accidently applied to the bottom of the pouch. This upward force may cause the entire pouch to move vertically relative to the belt and cause the clip to disengage from the belt. Being disengaged in such a manner results in the tool pouch falling away from the user. Where the user is on a ladder or other elevated structure, the tool pouch would fall beyond the user's reach and could also cause injury to anyone below the user.

It is an object of the present invention to provide a tool carrier that is easily installed on either a user's belt or a user's harness.

It is another object of the present invention to provide a tool carrier that would not fall beyond the user's reach if the tool carrier were inadvertently or accidentally disengaged from a user's belt or a user's harness.

The present invention achieves these and other objectives by providing a tool carrier that is adaptable for attachment to a user's belt or a user's harness without the need for removing the user's belt or the user's harness.

In one embodiment of the present invention, a tool carrier for removably attaching to a user's belt or a user's harness without disconnecting the user's belt or the user's harness includes a rear wall, a tool holder disposed on a front wall surface of the rear wall where the tool holder is one of a tool pouch or a tool loop, a tool carrier safety lanyard removably connected to the front wall surface of the rear wall, an elongated first attachment member fixedly secured to a rear loop portion of an upper wall portion of the rear wall at a pair of spaced-apart first and second attachment locations thereon in order to define a closed loop therebetween, and a first flexible strip having a first strip end and a second strip end where the first flexible strip is positioned through the closed loop of the elongated first attachment member. The rear wall also has a lower wall portion, a front wall surface, and a rear wall surface. The upper wall portion forms a loop having a front loop portion and the rear loop portion. The safety lanyard has a releasable member connected to a lanyard first end and a closed loop formed in a lanyard second end where the closed loop is configured for releasably attaching to the releasable member. The flexible strip forms an openable strip loop when the first strip end mates with the second strip end. The first flexible strip also provides for removably attaching the tool carrier to a user's belt without disconnecting the user's belt.

In another embodiment of the present invention, the tool pouch of the tool holder has a pouch wall secured to the front wall surface of the rear wall along two pouch side edges and a pouch bottom edge. The pouch wall forms an open pouch top and defines a space (or a plurality of spaces) between the pouch wall and the rear wall for receiving one or more hand tools. The tool pouch further includes a first tool lanyard compartment disposed on an outside surface of the tool pouch wall where the tool lanyard compartment defines a space for receiving a retractable tool lanyard component. The tool lanyard compartment has a first opening that is smaller than the retractable tool lanyard component and through which a tool attaching end of the tool lanyard component extends for attaching to a hand tool. The tool lanyard compartment also has a second opening for receiving the retractable tool lanyard component. Preferably, the second opening is at an opposite end of the tool lanyard compartment than the first opening. The second opening has a fastener mechanism for interacting with a mating component attached to the front wall surface of the pouch wall for preventing the retractable tool lanyard component from exiting the tool lanyard compartment unintentionally when the fastener mechanism is engaged.

In a further embodiment of the present invention, the tool carrier has a second tool lanyard compartment having a similar orientation as the first tool lanyard compartment. The second tool lanyard compartment is disposed on the outside surface of the pouch wall adjacent the first tool lanyard compartment. Like the first tool lanyard compartment, the second tool lanyard compartment has a first opening that is smaller than the retractable tool lanyard component and through which a tool attaching end of the tool lanyard component extends for attaching to a hand tool.

In still another embodiment of the present invention, the second tool lanyard compartment is disposed adjacent the first tool lanyard compartment in a position selected from the group consisting of vertically parallel to the open pouch top of the tool pouch and horizontally parallel to the open pouch top of the tool pouch.

In yet another embodiment of the present invention, the second tool lanyard compartment has a similar orientation as the first tool lanyard compartment where the second tool lanyard compartment is disposed on an outside surface of the first tool lanyard compartment. The second tool lanyard compartment has a first opening that is smaller than the retractable tool lanyard component and through which a tool attaching end of the tool lanyard component extends for attaching to a hand tool.

In another embodiment of the present invention, the second tool lanyard compartment is disposed adjacent the first tool lanyard compartment in a position selected from the group consisting of vertically parallel to the open pouch top of the tool pouch and horizontally parallel to the open pouch top of the tool pouch.

In a further embodiment of the tool carrier of the present invention, the tool loop includes an elongated member fixedly secured to the front wall surface of the rear wall at a pair of spaced-apart first and second member securing locations thereon in order to define a closed loop therebetween. The elongated member forms a tool receiving opening through which a tool handle of a tool having a hand tool head larger than the tool handle is received where the tool head is supported by a middle portion of the elongated member that forms the tool receiving opening.

In another embodiment of the tool carrier of the present invention, there is an elongated second attachment member fixedly secured to the front loop portion of the upper wall portion at a pair of spaced-apart first and second attachment locations thereon and defining a closed loop therebetween. There is also an elongated third attachment member fixedly secured to the rear wall surface adjacent a bottom rear wall edge at a pair of spaced-apart first and second attachment locations thereon and defining a closed loop therebetween.

In still another embodiment, the tool carrier includes a second flexible strip and a third flexible strip. The second flexible strip has a first strip end and a second strip end that forms an openable loop when the first strip end mates with the second strip end. The openable strip loop of the second flexible strip is positioned through the closed loop of the elongated second attachment member. The third flexible strip has a first strip end and a second strip end that forms an openable loop when the first strip end mates with the second strip end. The openable strip loop of the third flexible strip is positioned through the closed loop of the elongated third attachment member. The second flexible strip and the third flexible strip provides for removably attaching the tool carrier to a user's harness without disconnecting the user's harness.

In yet a further embodiment of the present invention, the upper wall portion of the rear wall is bendable at or adjacent a junction of the upper wall portion and the lower wall portion in a direction such that the second flexible strip faces rearwardly of the tool carrier when the upper wall portion of the rear wall portion is folded rearwardly to position the second flexible strip and the third flexible strip for attachment to a harness.

In another embodiment of the present invention, a method of using is disclosed. The method includes providing a tool carrier having a rear wall with an upper wall portion that forms a loop having a front loop portion and a rear loop portion, and a tool carrier safety lanyard removably connected to the front wall surface of the rear wall, attaching the tool carrier to a user's belt or a user's harness, and attaching the tool carrier safety lanyard to the user's belt or the user's harness in an orientation and configuration that prevents accidental release from the user's belt or the user's harness when the tool carrier is attached to the user's belt or the user's harness. The safety lanyard has a releasable member connected to a lanyard first end and a closed loop formed in a lanyard second end where the closed loop is configured for releasably attaching to the releasable member.

In another embodiment of the method of the present invention, the method further includes providing a first flexible strip capable of forming an openable strip loop when a first strip end mates with a second strip end, inserting the first strip end of the first flexible strip through a closed loop formed by an elongated first attachment member that is fixedly secured to the rear loop portion of the upper wall portion at a pair of spaced-apart first and second attachment locations, and attaching the first flexible strip to a user's belt by looping the first strip end around the user's belt and mating the first strip end to the second strip end to provide attachment of the tool carrier to the user's belt without disconnecting or removing the user's belt.

In a further embodiment of the method, the method includes providing a second flexible strip and a third flexible strip where each flexible strip forms an openable strip loop when a first strip end mates with a second strip end, inserting the first strip end of the second flexible strip through a closed loop formed by an elongated second attachment member that is fixedly secured to a front wall surface of the rear wall at a pair of spaced-apart first and second member securing locations thereon defining the closed loop therebetween, inserting the first strip end of the third flexible strip through a closed loop formed by an elongated third attachment member that is fixedly secured to a rear wall surface adjacent a bottom rear wall edge at a pair of spaced-apart first and second attachment locations thereon defining the closed loop therebetween, bending the upper wall portion of the rear wall over the rear wall surface of the rear wall where the elongated second attachment member is directionally oriented in a similar direction as the elongated third attachment member, attaching the second flexible strip to a user's harness by looping the first strip end around the user's harness and mating the first strip end to the second strip end when attaching to a user's harness without disconnecting or removing the user's harness, and attaching the third flexible strip to a user's harness by looping the first strip end around the user's harness and mating the first strip end to the second strip end when attaching to a user's harness without disconnecting or removing the user's harness.

In another embodiment of the method of the present invention, the step of attaching the tool carrier safety lanyard includes looping a lanyard second end around a user's belt or a user's harness and attaching a closed loop of the lanyard second end to the releasable member of the lanyard first end.

DETAILED DESCRIPTION OF THE PREFERRED EMBODIMENT

Figure 1:
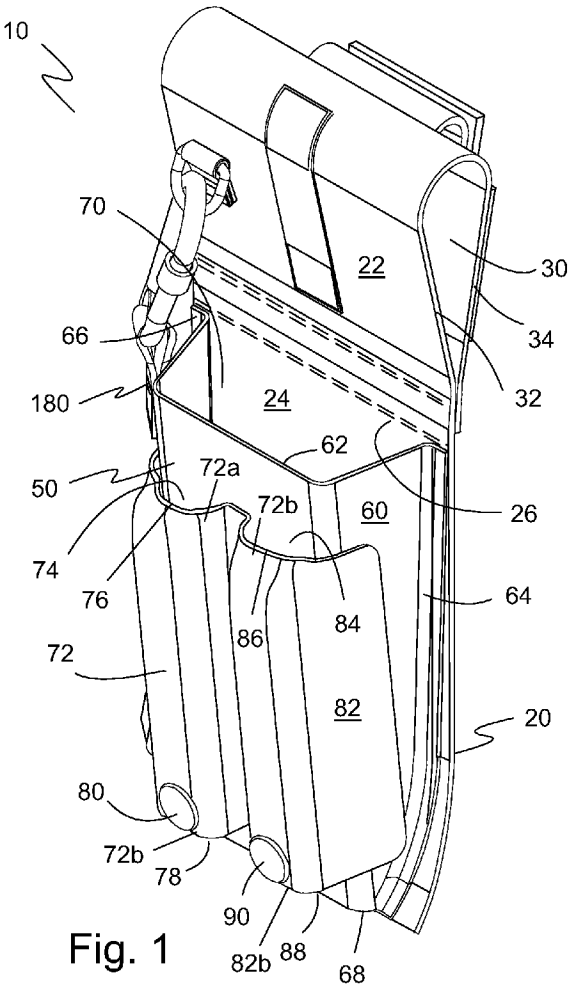
FIG. 1 is a front, perspective view of one embodiment of the present invention showing a tool carrier with a tool carrier safety lanyard and a tool pouch.

The preferred embodiments of the present invention are illustrated in FIGS. 1-9. FIG. 1 shows one embodiment of a tool carrier 10 of the present invention. Tool carrier 10 includes a rear wall 20 with a front wall surface 26, a tool holder 50 disposed on the front wall surface 26, and a tool carrier safety lanyard 180 removably connected to the front wall surface 26. The rear wall 20 has an upper wall portion 22 and a lower wall portion 24. Rear wall 20 is bendable at the junction of upper wall portion 22 and lower wall portion 24, whose functions will be explained later. Upper wall portion 22 forms an optional loop 30 that includes a front loop portion 32 and a rear loop portion 34. Instead of using or forming an optional loop 30, it is also contemplated that rear wall 20 does not form a closed loop at or in upper wall portion 22 and presents only an upper wall portion 20 that is planar. Optional loop 30 is provided for those users who prefer sliding the tool carrier 10 onto a belt by passing one end of the belt through loop 30 and refastening the belt. This, however, makes attaching and removing the tool carrier 10 inconvenient. Rear wall 20 may be made of a variety of materials including polyurethane, PVC, polyester, nylon webbing, and the like. Polyurethane is the preferred material because it is easy to clean.

Tool carrier safety lanyard 180 is a key feature of the present invention that provides, as the name implies, a safety lanyard to prevent the tool carrier 10 from falling away from the user when the user engages the attachment configuration that allows the user to attach tool carrier 10 to the user's belt or the user's harness without having to disengage/disconnect the belt or harness. This feature will be explained more fully later.

Tool holder 50 shown in this embodiment is a tool pouch 60. Tool pouch 60 has a pouch wall 62 secured to front wall surface 26 of rear wall 20. Pouch wall 62 is secured along two pouch side edges 64, 66 and along pouch bottom edge 68 forming an open pouch top 70. Pouch wall 62 defines a space 70 between pouch wall 62 and rear wall 20 for receiving and holding one or more hand tools. It is contemplated that space 70 may be divided into a plurality of tool holder spaces (not shown).

Tool pouch 60 optionally includes a first tool lanyard compartment 72 disposed on an outside surface 63 of pouch wall 62. First tool lanyard compartment 72 defines space 74 for receiving a retractable tool lanyard component (not shown) with a first opening 76 at a first compartment end 72*a* and a second opening 78 at a second compartment end 72*b*. First opening 76 is sized to be smaller than the retractable lanyard component to be inserted into space 74 and through which a tool attaching end of the tool lanyard component extends for attaching to a hand tool disposed in tool pouch 60. Second opening 78 at second compartment end 72*b* is sized to allow placement of a retractable tool lanyard component within space 74 of first tool lanyard compartment 72. Second opening 78 also includes a fastener mechanism 80 that interacts or mates with a mating component attached to rear wall 20 for retaining the retractable tool lanyard component within first tool lanyard compartment 72 until a user desires its removal. Fastener mechanism 80 when engaged prevents the retractable tool lanyard component from exiting the tool lanyard compartment 72 unintentionally.

Tool pouch 60 may also optionally include a second tool lanyard compartment 82 that defines a space 84 for receiving a retractable tool lanyard component (not shown) with a first opening 86 at a first compartment end 82*a* and a second opening 88 at a second compartment end 82*b*. Like first tool lanyard compartment 72, first opening 86 is sized to be smaller than the retractable lanyard component to be inserted into space 84 and through which a tool attaching end of the tool lanyard component extends for attaching to a hand tool disposed in tool pouch 60. Second opening 88 at second compartment end 82*b* is sized to allow placement of a retractable tool lanyard component within space 84 of first tool lanyard compartment 72. Tool pouch 60 and first and second tool lanyard compartments 72, 82 may be made of polyurethane, polyvinyl chloride, nylon, polyester, and the like. A vinyl coated polyester is preferred.

Figure 2:
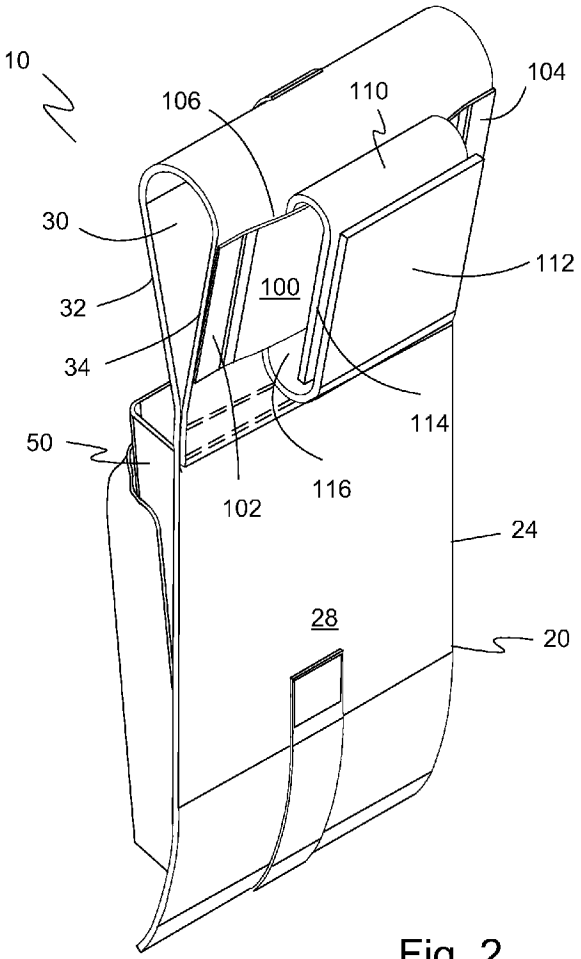
FIG. 2 is a rear, perspective view of the embodiment shown in FIG. 1 of the present invention showing a tool carrier with a first flexible strip attached to an elongated first attachment member for attaching to a user's belt.

FIG. 2 illustrates a rear, perspective view of the embodiment of tool carrier 10 shown in FIG. 1. FIG. 2 shows another key feature of the present invention, which is the ability of a user to attach or remove tool carrier 10 to or from, respectively, the user's belt without having to disengage, disconnect or remove the user's belt. As can be seen and has been previously described, loop 30 of upper wall portion 22 has front loop portion 32 and rear loop portion 34. Rear loop portion 34 includes an elongated first attachment member 100 fixedly secured to rear loop portion 34 at a pair of spaced-apart first and second attachment locations 102, 104. Elongated first attachment member 100 defines a closed loop 106 between spaced-apart first and second attachment locations 102, 104 and the surface of rear loop portion 34. A first flexible strip 110 is provided that cooperates with closed loop 106. First flexible strip 110 has a first strip end 112 and a second strip end 114. First flexible strip 110 forms an openable strip loop 116 when first strip end 112 mates with second strip end 114. The mating structure of first and second strip ends 112, 114 is preferably hook and loop fastener but may also be snaps, buttons, clips, belt fastening components, and the like. As shown, first flexible strip 110 is positioned through closed loop 106 of elongated first attachment member 100. First flexible strip 110 provides the user with the ability for removably attaching the tool carrier 10 to a user's belt without disengaging, disconnecting or removing the user's belt. It is also noted that the first attachment member 100 is attached to the front wall surface 26 of rear wall 20 since the upper wall portion 22 forms loop 30 and the front wall surface 26 extends around to the rear of tool carrier 10.

Figure 3:
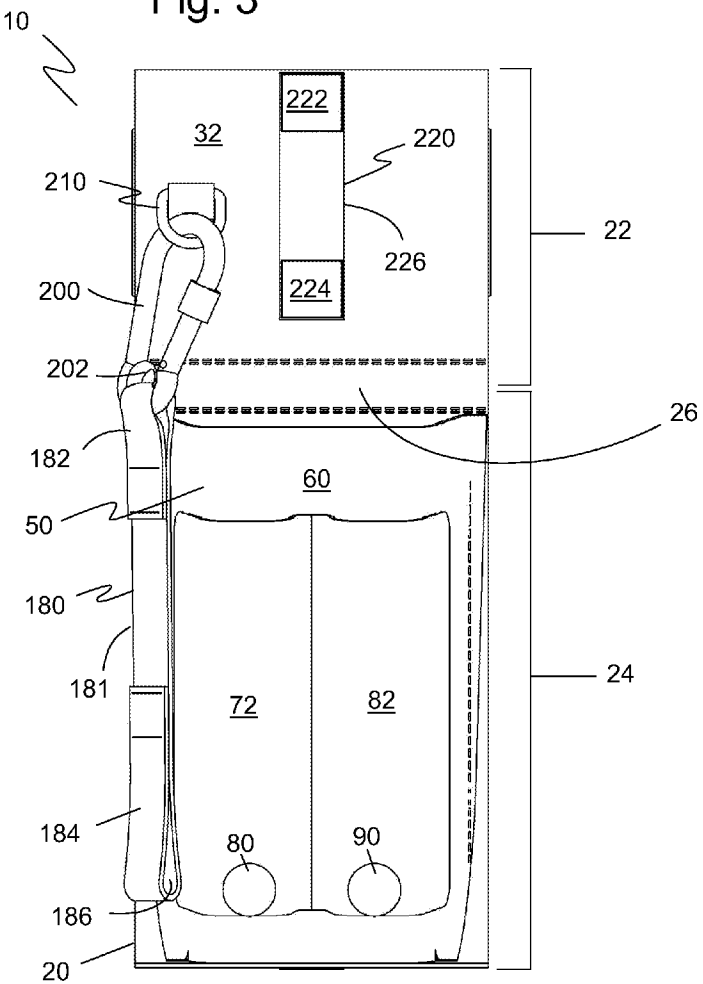
FIG. 3 is a front plan view of the embodiment shown in FIG. 1.

Turning now to FIG. 3, there is illustrated a front plan view of tool carrier 10. As is more easily seen, rear wall 20 is divided into upper wall portion 22 and lower wall portion 24. Upper wall portion 22 has loop 30 with front loop portion 32 facing the viewer. Tool holder 50 is tool pouch 60 for holding one or more hand tools (not shown) and tool pouch 60 further includes first and second tool lanyard compartments 72, 82, respectively. In this view, tool carrier safety lanyard 180 is more clearly shown. Tool carrier safety lanyard 180 includes a lanyard body 181, a lanyard first end 182 and a lanyard second end 184. A fixed loop 186 is formed at each of lanyard first and second ends 182, 184. Fixed loop 186 at lanyard first end 182 is connected to an openable fastener mechanism 200, which is preferably a carabiner and, more preferably, a locking carabiner. Preferably, fixed loop 186 at lanyard first end 182 is looped through a fixed opening 202 in fastener mechanism 200 that has a smooth, curved surface to prevent chaffing of fixed loop 186. Fastener mechanism 200 is preferably attached to a clip-receiving holder 210. Also shown on front loop portion 32 of upper wall portion 22 is an elongated second attachment member 220 fixedly secured at a pair of spaced-apart first and second attachment locations 222, 224 thereon in order to define a closed loop 226 therebetween.

Figure 4:
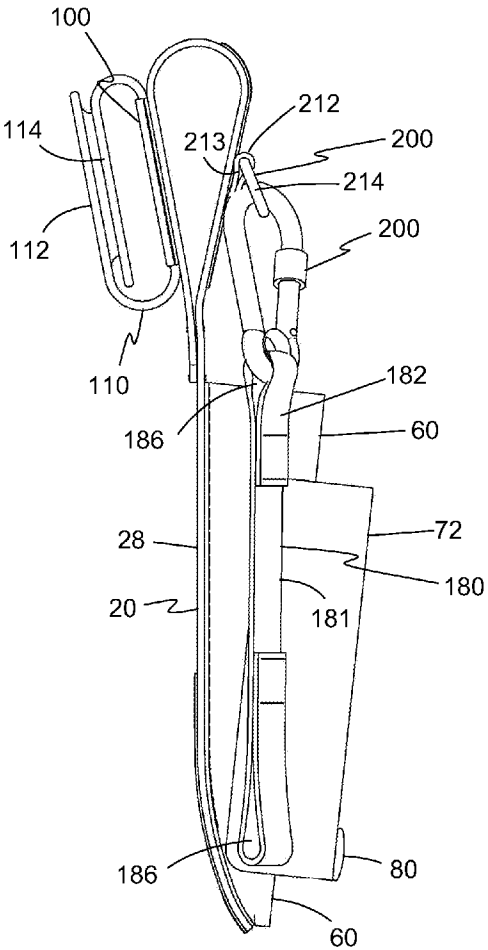
FIG. 4 is a side plan view of the embodiment shown in FIG. 1.

FIG. 4 is a side plan view of tool carrier 10 showing the preferred spatial relationship of pouch 60 and tool lanyard compartment 72 to rear wall 20 as well as first flexible strip 110 attached to elongated first attachment member 100. In this view, the preferred embodiment of fastener mechanism 200 is more clearly shown. Fastener mechanism 200 includes a looped material 212 securely and fixedly attached to front wall surface 26 of rear wall 20 and looped material 212 has a loop opening 213 that captures a ring 214, preferably a D-ring. Looped material 212 is attached using a known type fastener such as adhesive, rivets, stitching, and the like, all as is well known to those of ordinary skill in the art. In this embodiment, fastener mechanism 200 is attached to upper wall portion 22, however, it is understood that fastener mechanism 200 may be attached to any location on front wall surface 26 or rear wall surface of lower wall portion 24 or onto pouch 60 or tool lanyard compartments 72, 82.

Figure 5:
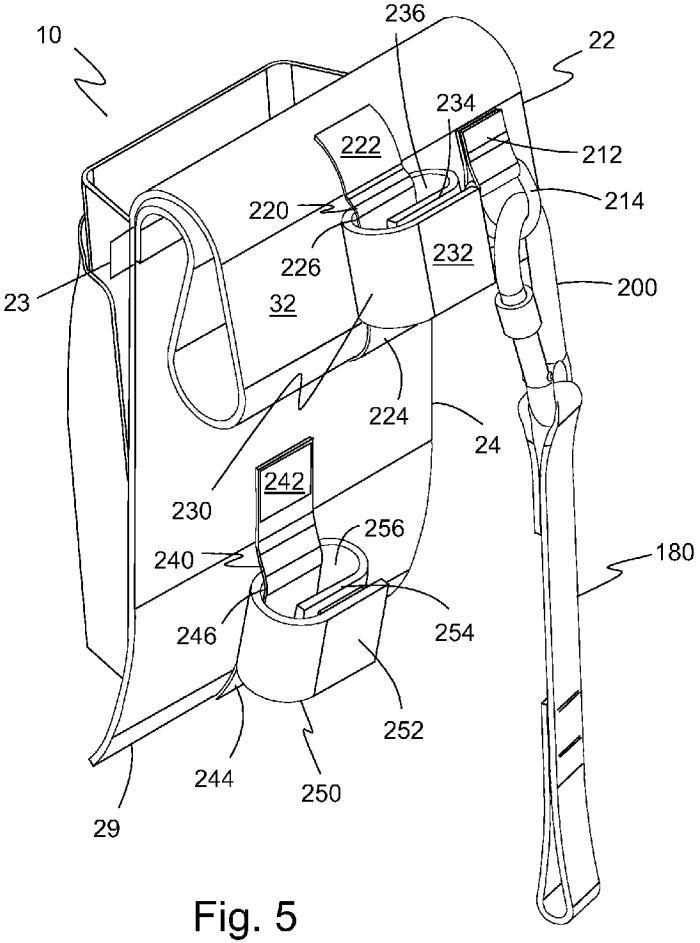
FIG. 5 is a rear, perspective view of the embodiment shown in FIG. 1 showing a second and a third flexible strip attached to elongated second and third attachment members with the upper wall portion in a bent orientation.

Turning now to FIG. 5, there is illustrated another optional feature of the present invention. In this embodiment, upper wall portion 22 is bendable at a junction 23 between upper wall portion 22 and lower wall portion 24. Bending of rear wall 20 at junction 23 effectively positions elongated second attachment member 220, which is fixedly secured at the pair of spaced-apart first and second attachment locations 222, 224 thereon and defining a closed loop 226 therebetween, in the same direction as an elongated third attachment member 240. A second flexible strip 230 is provided that cooperates with closed loop 226. Second flexible strip 230 has a first strip end 232 and a second strip end 234. Second flexible strip 230 forms an openable strip loop 236 when first strip end 232 mates with second strip end 234. The mating structure of first and second strip ends 232, 234 is preferably hook and loop fastener but may also be snaps, buttons, clips, belt fastening components, and the like. As shown, second flexible strip 230 is positioned through closed loop 226 of elongated second attachment member 220.

Elongated third attachment member 240 is fixedly secured to rear wall surface 28 closer to a bottom rear wall edge 29 than to junction 23 at a pair of spaced-apart first and second attachment locations 242, 244 thereon in order to define a closed loop 246 therebetween. A third flexible strip 250 is provided that cooperates with closed loop 246. Third flexible strip 250 has a first strip end 252 and a second strip end 254. Third flexible strip 250 forms an openable strip loop 256 when first strip end 252 mates with second strip end 254. The mating structure of first and second strip ends 252, 254 is preferably hook and loop fastener but may also be snaps, buttons, clips, belt fastening components, and the like. As shown, third flexible strip 250 is positioned through closed loop 246 of elongated third attachment member 240. Second and third flexible strips 230, 250 provide the user with the ability for removably attaching the tool carrier 10 to a user's harness without disconnecting the user's harness. It is noted that the use of two distinct and separate second and third flexible strips 230, 250 provides stability to tool carrier 10 when mounted to the vertical webbing of a harness. Further, bending of upper wall portion 22 at junction 23 provides a distinct advantage to tool carrier 10 by providing a smaller tool carrier profile when mounted to a harness.

Figure 6:
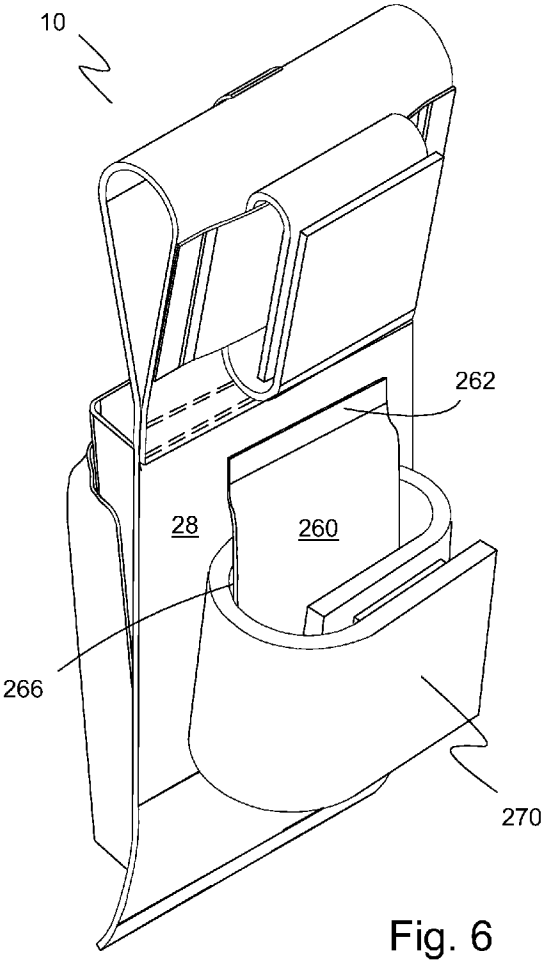
FIG. 6 is a rear, perspective view of another embodiment of the present invention showing a harness flexible strip attached to a harness attachment member.

In an alternative embodiment shown in FIG. 6 and instead of having elongated second attachment member 220 on front loop portion 32 and elongated third attachment member 240 on rear wall surface 28, there may be only one attachment member secured to rear wall surface 28. In this embodiment, the attachment member is a harness attachment member 260 having a length longer than either of second or third attachment members 220, 240. Like second and third attachment components 220, 240, harness attachment member 260 is fixedly secured to rear wall surface 28 at a pair of spaced-apart first and second attachment locations 262, 264 (not shown) thereon defining a closed loop 266 therebetween. The length of harness attachment member 260 is such that it allows a harness flexible strip 270 having a width sufficient to stabilize tool carrier 10 when attached to a user's harness even when a plurality of hand tools are placed within pouch 60.

The advantages of either embodiment previously described includes enabling a user to install the tool carrier 10 on a belt or harness without having to remove the belt or the harness, providing one product that may be either belt-mounted or harness-mounted using the flexible strip system for attaching the tool carrier 10, and preventing the tool carrier 10 from being a dropped object should the flexible attachment system fail. For the bendable, fold-down option as shown in FIG. 5, this provides for a reduced overall profile of the tool carrier which, in turn, allows for occupying a smaller area when using it on a vertical webbing of a harness.

Figure 8:
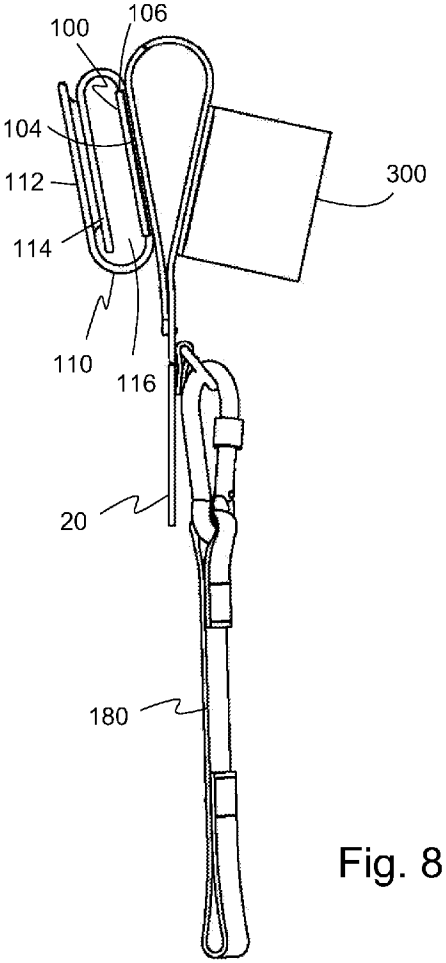
FIG. 8 is a side, plan view of the embodiment shown in FIG. 7.
Figure 7:
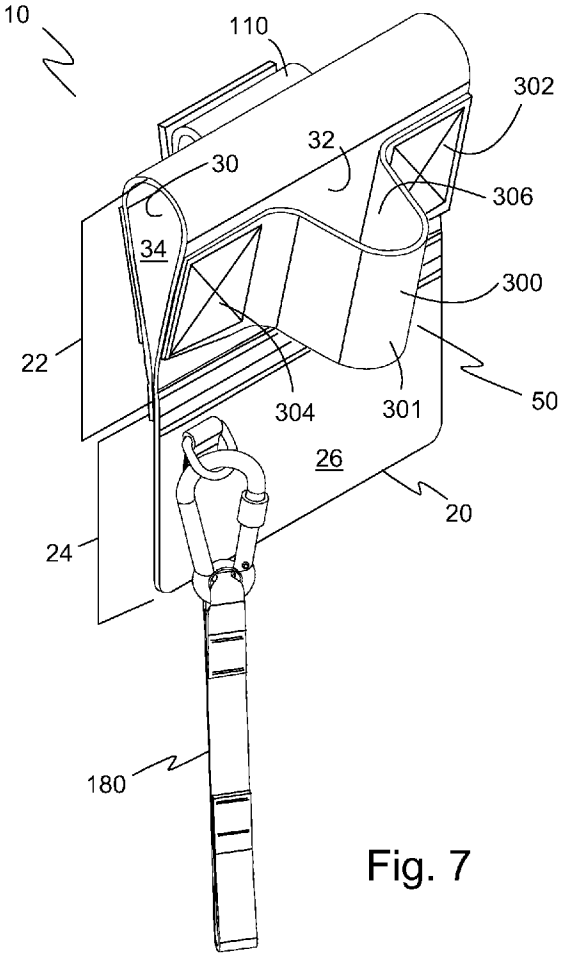
FIG. 7 is a front, perspective view of another embodiment of the present invention showing a tool carrier with a tool carrier safety lanyard and a tool holder.

Turning now to FIGS. 7 and 8, there is shown another embodiment of tool carrier 10 of the present invention. In this embodiment, tool carrier 10 has a rear wall 20 with a front wall surface 26, a tool holder 50 disposed on the front wall surface 26, and a tool carrier safety lanyard 180 removably connected to the front wall surface 26. The rear wall 20 has an upper wall portion 22 and a lower wall portion 24. Upper wall portion 22 forms an optional loop 30 that includes a front loop portion 32 and a rear loop portion 34. Optional loop 30 is provided for those users who prefer sliding the tool carrier 10 onto a belt by passing one end of the belt through loop 30 and refastening the belt. This, however, makes attaching and removing the tool carrier 10 inconvenient.

Tool holder 50 shown in this embodiment is a tool loop 300. Tool loop 300 has a loop strip 301 secured to front wall surface 26 of rear wall 20. Loop strip 301 is fixedly and securely attached to front wall surface 26 at a pair of spaced-apart first and second loop strip locations 302, 304 thereon and defining a closed loop 306 therebetween. Closed loop 306 is sized for receiving a handle of a hand tool but does not allow a head portion of a hand tool to pass through closed loop 306. Loop strip 301 effectively supports the head portion of the hand tool when a hand tool is placed into tool loop 300. An example of such a hand tool includes, but is not limited to, a hammer, a hand axe, etc.

Similarly, this embodiment of tool carrier 10 includes an elongated first attachment member 100 fixedly secured to rear loop portion 34 at a pair of spaced-apart first and second attachment locations 102, 104. Elongated first attachment member 100 defines a closed loop 106 between spaced-apart first and second attachment locations 102, 104 and the surface of rear loop portion 34. A first flexible strip 110 is provided that cooperates with closed loop 106. First flexible strip 110 has a first strip end 112 and a second strip end 114. First flexible strip 110 forms an openable strip loop 116 when first strip end 112 mates with second strip end 114. The mating structure of first and second strip ends 112, 114 is preferably hook and loop fastener but may also be snaps, buttons, clips, belt fastening components, and the like. As shown, first flexible strip 110 is positioned through closed loop 106 of elongated first attachment member 100. First flexible strip 110 provides the user with the ability for removably attaching the tool carrier 10 to a user's belt without disconnecting the user's belt.

Figure 9:
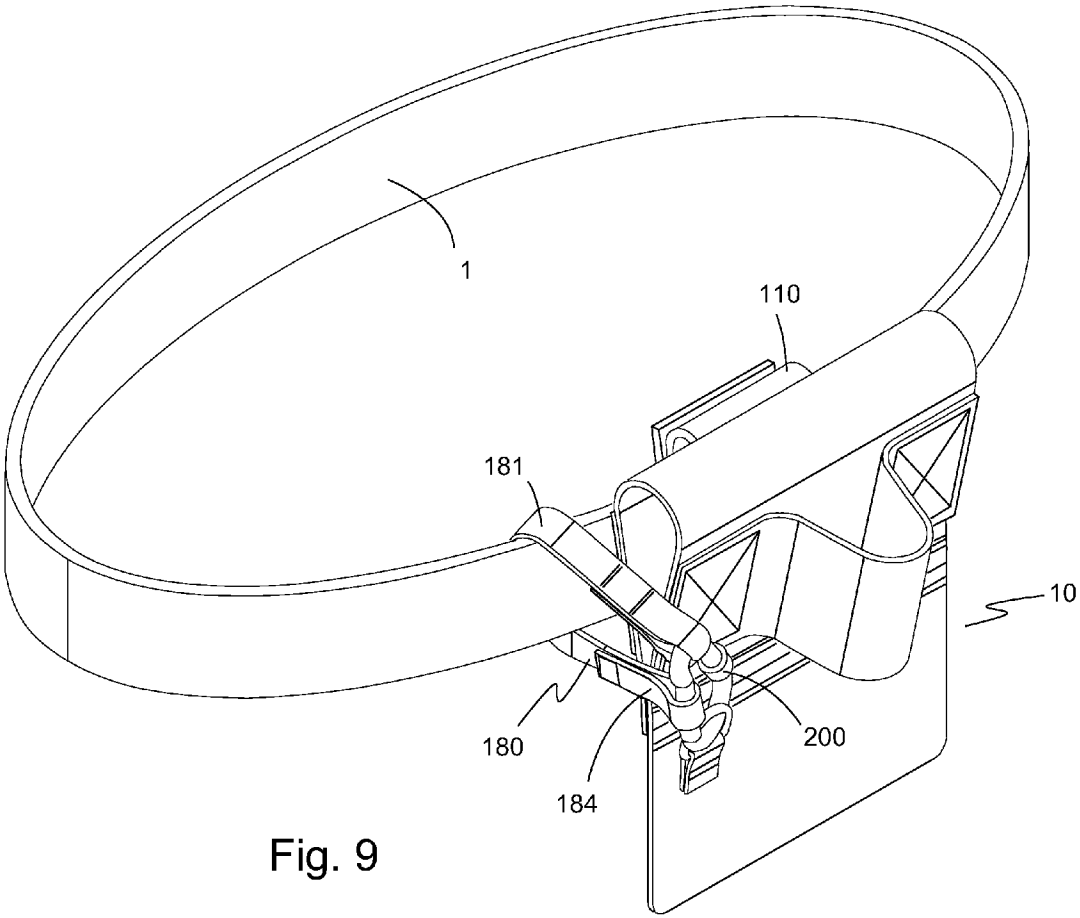
FIG. 9 is a front, perspective view of the embodiment shown in FIG. 7 attached to a user's belt showing the tool carrier safety lanyard engaged with the user's belt.

Turning now to FIG. 9, there is illustrated the tool carrier safety lanyard 180 of the present invention in use. Although the tool loop embodiment of tool carrier 10 is illustrated, it should be understood that the tool pouch embodiment may be readily substituted. As can be seen, first flexible strip 110 is wrapped around a user's belt 1 and holds tool carrier 10 to user's belt 1. Tool carrier safety lanyard 180 is also attached to user's belt 1. Tool carrier safety lanyard 180 may be attached in a couple of ways. Safety lanyard body 181 is looped around belt 1 and closed loop 186 of lanyard second end 184 is held by releasable member 200. Alternatively, safety lanyard body 181 is looped around belt 1 and lanyard first end 182 is passed through the closed loop 186 of lanyard second end 184 creating a cinch knot around belt 1. The cinch knot attaching orientation is the preferred mode of attachment to belt 1. Tool carrier safety lanyard 180 prevents tool carrier 10 from falling away from the user in the event that first and second strip ends 112, 114 separate or unmate from each other causing first flexible strip 110 to inadvertently or accidently open. Without tool carrier safety lanyard 180, any inadvertent or accidental opening of first flexible strip 110 would allow tool carrier 10 to fall away from the user with the potential of injuring someone who may be below the user.

Use of the present invention for removably attaching a tool carrier 10 to a user's belt or a user's harness will now be explained. The method involves providing tool carrier 10 having rear wall 20 with upper wall portion 22 that forms loop 30 having front loop portion 32 and rear loop portion 34, and tool carrier safety lanyard 180 removably connected to front wall surface 26 of rear wall 20. For attaching to a user's belt, first flexible strip 110 is provided that is capable of forming an openable strip loop 116 when first strip end 112 mates with second strip end 114. First strip end 112 of first flexible strip 110 is inserted through closed loop 106 formed by elongated first attachment member 100, which is fixedly secured to rear loop portion 34 of upper wall portion 22 at the pair of spaced-apart first and second attachment locations 102, 104. First flexible strip 110 is looped around a user's belt and first strip end 112 is mated to second strip end 114 securing tool carrier 10 onto the user's belt.

For attaching the preferred embodiment to a user's harness, a second flexible strip 230 and a third flexible strip 250 is provided where each flexible strip 230, 250 forms an openable strip loop 236, 256 when first strip end 232, 252 mates with second strip end 234, 254, respectively. First strip end 232 of second flexible strip 230 is inserted through closed loop 226 formed by elongated second attachment member 220, which is fixedly secured to front wall surface 26 of rear wall 20 at the pair of spaced-apart first and second member securing locations 222, 224 thereon defining the closed loop 226 therebetween. First strip end 252 of third flexible strip 250 is inserted through closed loop 246 formed by elongated third attachment member 240, which is fixedly secured to rear wall surface 28 of rear wall 20 at the pair of spaced-apart first and second member securing locations 242, 244 thereon defining the closed loop 246 therebetween. Upper wall portion 22 of rear wall 20 is bent at junction 23 over rear wall surface 28 of rear wall 20 so that elongated second attachment member 220 is directionally oriented in a similar direction as elongated third attachment member 240. Second flexible strip 230 is connected to a user's harness by looping first strip end 232 around the vertical webbing of a user's harness and mating first strip end 232 to second strip end 234 without disconnecting or removing the user's harness. Third flexible strip 250 is connected to a user's harness by looping first strip end 250 around the vertical webbing of the user's harness and mating first strip end 252 to second strip end 254 without disconnecting or removing the user's harness.

In each case where the tool carrier 10 is attached to the user's belt or the user's harness, the final step is to attach the tool carrier safety lanyard 180. Lanyard second end 184 is looped around a user's belt or the webbing of a user's harness and closed loop 186 of lanyard second end 184 is attached to releasable member 200 of lanyard first end 182.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A tool carrier for removably attaching to a user's belt or a user's harness and a belt or a harness, the tool carrier comprising:

a rear wall having an upper wall portion, a lower wall portion, a front wall surface, and a rear wall surface;

a tool holder disposed on the front wall surface of the rear wall, the tool holder selected from the group consisting of a tool pouch and a tool loop;

a tool carrier safety lanyard removably connected to the front wall surface of the rear wall, the safety lanyard having a releasable member connected to a lanyard first end and a closed loop formed in a lanyard second end wherein the tool carrier safety lanyard loops around the one of a belt or a harness and the closed loop is either attached to the releasable member or receives the releasable member therethrough, the releasable member being removably connected to a fastener mechanism fixedly attached to the tool carrier, to thereby prevent the tool carrier from accidentally or inadvertently falling away from the one of a belt or a harness;

an elongated first attachment member fixedly secured to the rear wall surface of the upper wall portion at a pair of spaced-apart first and second attachment locations thereon in order to define a closed loop therebetween wherein the elongated first attachment member extends transversely relative to pouch side edges;

an elongated second attachment member fixedly secured to the front loop portion of the upper wall portion at a pair of spaced-apart first and second attachment locations thereon in order to define a closed loop therebetween wherein the elongated second attachment member extends parallel relative to pouch side edges and the closed loop is accessible in the transverse direction relative to the pouch side edges; and an elongated third attachment member fixedly secured to the rear wall surface adjacent a bottom rear wall edge at a pair of spaced-apart first and second attachment locations thereon in order to define a closed loop therebetween wherein the elongated third attachment member extends parallel relative to pouch side edges and the closed loop is accessible in the transverse direction relative to the pouch side edges;

whereby, when upper wall portion is folded backward toward the rear wall portion, the elongated second attachment member and the elongated third attachment member present aligned loops for receiving an openable flexible strip for attachment to a harness.

2. The tool carrier of claim 1 wherein the upper wall portion forms a loop having a front loop portion and a rear loop portion and wherein the elongated first attachment member is fixedly secured to the rear loop portion at a pair of spaced-apart first and second attachment locations thereon in order to define a closed loop therebetween.

3. The tool carrier of claim 2 wherein the tool pouch of the tool holder has a pouch wall secured to the front wall surface of the rear wall along two pouch side edges and a pouch bottom edge forming an open pouch top and defining a space between the pouch wall and the rear wall for receiving one or more hand tools, the tool pouch further including a first tool lanyard compartment disposed on an outside surface of the tool pouch wall wherein the tool lanyard compartment defines a space for receiving a retractable tool lanyard component, the tool lanyard compartment having a first opening that is smaller than the retractable tool lanyard component and through which a tool attaching end of the tool lanyard component extends for attaching to a hand tool, and a second opening for receiving the retractable tool lanyard component, the second opening having a fastener mechanism for interacting with a mating component attached to the front wall surface of the pouch wall for preventing the retractable tool lanyard component from exiting the tool lanyard compartment unintentionally when the fastener mechanism is engaged.

4. The tool carrier of claim 3 further comprising a second tool lanyard compartment having a similar orientation as the first tool lanyard compartment wherein the second tool lanyard compartment is disposed on the outside surface of the pouch wall adjacent the first tool lanyard compartment, the second tool lanyard compartment having a first opening that is smaller than the retractable tool lanyard component and through which a tool attaching end of the tool lanyard component extends for attaching to a hand tool.

5. The tool carrier of claim 4 wherein the second tool lanyard compartment is disposed adjacent the first tool lanyard compartment in a position selected from the group consisting of vertically parallel to the open pouch top of the tool pouch and horizontally parallel to the open pouch top of the tool pouch.

6. The tool carrier of claim 3 wherein further comprising a second tool lanyard compartment having a similar orientation as the first tool lanyard compartment wherein the second tool lanyard compartment is disposed on an outside surface of the first tool lanyard compartment, the second tool lanyard compartment having a first opening that is smaller than the retractable tool lanyard component and through which a tool attaching end of the tool lanyard component extends for attaching to a hand tool.

7. The tool carrier of claim 1 further comprising a second flexible strip and a third flexible strip wherein the second flexible strip has a first strip end and a second strip end that forms an openable loop when the first strip end mates with the second strip end, the openable strip loop of the second flexible strip being positioned through the closed loop of the elongated second attachment member, and wherein the third flexible strip has a first strip end and a second strip end that forms an openable loop when the first strip end mates with the second strip end, the openable strip loop of the third flexible strip being positioned through the closed loop of the elongated third attachment member whereby the second flexible strip and the third flexible strip provides for removably attaching the tool carrier to a user's harness without disconnecting the user's harness.

8. The tool carrier of claim 7 wherein the upper wall portion of the rear wall is bendable at or adjacent a junction of the upper wall portion and the lower wall portion wherein the second flexible strip faces rearwardly of the tool carrier when the upper wall portion of the rear wall portion is folded rearwardly to position the second flexible strip and the third flexible strip for attachment to a harness.

9. A method of using a tool carrier for removably attaching the tool carrier to a user's belt or a user's harness, the method comprising:

providing a tool carrier having a rear wall with an upper wall portion that forms a loop having a front loop portion and a rear loop portion wherein the tool carrier has (a) an elongated first attachment member fixedly secured to the rear wall surface of the upper wall portion at a pair of spaced-apart first and second attachment locations thereon in order to define a closed loop therebetween wherein the elongated first attachment member extends transversely relative to pouch side edges, (b) an elongated second attachment member fixedly secured to the front loop portion of the upper wall portion at a pair of spaced-apart first and second attachment locations thereon in order to define a closed loop therebetween wherein the elongated second attachment member extends parallel relative to pouch side edges and the closed loop is accessible in the transverse direction relative to the pouch side edges;

(c) an elongated third attachment member fixedly secured to the rear wall surface adjacent a bottom rear wall edge at a pair of spaced-apart first and second attachment locations thereon in order to define a closed loop therebetween wherein the elongated third attachment member extends parallel relative to pouch side edges and the closed loop is accessible in the transverse direction relative to the pouch side edges; and (d) a tool carrier safety lanyard removably connected to the front wall surface of the rear wall, the safety lanyard having a releasable member connected to a lanyard first end and a closed loop formed in a lanyard second end wherein the closed loop is configured for releasably attaching to the releasable member;

attaching the tool carrier to a user's belt or a user's harness; and attaching the tool carrier safety lanyard to the user's belt or the user's harness by looping the tool carrier safety lanyard around the user's belt or the user's harness and the closed loop is then either attached to the releasable member or receives the releasable member therethrough, the releasable member being removably connected to a fastener mechanism fixedly attached to the tool carrier, to thereby prevent accidental release from the user's belt or the user's harness when the tool carrier is attached to the user's belt or the user's harness.

10. The method of claim 9 further comprising:

providing a first flexible strip capable of forming an openable strip loop when a first strip end mates with a second strip end;

inserting the first strip end of the first flexible strip through a closed loop formed by an elongated first attachment member that is fixedly secured to the rear loop portion of the upper wall portion at a pair of spaced-apart first and second attachment locations; and attaching the first flexible strip to a user's belt by looping the first strip end around the user's belt and mating the first strip end to the second strip end to provide attachment of the tool carrier to the user's belt without disconnecting the user's belt.

11. The method of claim 9 further comprising:

providing a second flexible strip and a third flexible strip wherein each flexible strip forms an openable strip loop when a first strip end mates with a second strip end;

inserting the first strip end of the second flexible strip through a closed loop formed by an elongated second attachment member that is fixedly secured to a front wall surface of the rear wall at a pair of spaced-apart first and second member securing locations thereon defining the closed loop therebetween;

inserting the first strip end of the third flexible strip through a closed loop formed by an elongated third attachment member that is fixedly secured to a rear wall surface adjacent a bottom rear wall edge at a pair of spaced-apart first and second attachment locations thereon defining the closed loop therebetween;

bending the upper wall portion of the rear wall over the rear wall surface of the rear wall wherein the elongated second attachment member is directionally oriented in a similar direction as the elongated third attachment member;

attaching the second flexible strip to a user's harness by looping the first strip end around the user's harness and mating the first strip end to the second strip end when attaching to a user's harness without disconnecting the user's harness; and attaching the third flexible strip to a user's harness by looping the first strip end around the user's harness and mating the first strip end to the second strip end when attaching to a user's harness without disconnecting the user's harness.

12. The method of claim 9 wherein the step of attaching the tool carrier safety lanyard further includes looping a lanyard second end around a user's belt or a user's harness and attaching a closed loop of the lanyard second end to the releasable member of the lanyard first end.

* * * * *